US006810616B2

(12) United States Patent
Tal et al.

(10) Patent No.: US 6,810,616 B2
(45) Date of Patent: Nov. 2, 2004

(54) MAGAZINE LOADER AND UNLOADER ACCESSORY

(76) Inventors: Guy Tal, 86 Shilo St., Rosh Ha'ain (IL), 48036; Ran Tal, 48 Brodetzki St., Tel Aviv (IL), 69051

( * ) Notice: Subject to any disclaimer, the term of this patent is extended or adjusted under 35 U.S.C. 154(b) by 0 days.

(21) Appl. No.: 10/332,760

(22) PCT Filed: Jul. 22, 2001

(86) PCT No.: PCT/IL01/00672

§ 371 (c)(1),
(2), (4) Date: Jan. 14, 2003

(87) PCT Pub. No.: WO02/08681

PCT Pub. Date: Jan. 31, 2002

(65) Prior Publication Data

US 2004/0020096 A1 Feb. 5, 2004

Related U.S. Application Data

(60) Provisional application No. 60/221,393, filed on Jul. 23, 2000, now abandoned.

(51) Int. Cl.[7] ..... F41A 9/84
(52) U.S. Cl. ..... 42/87; 42/90
(58) Field of Search ..... 42/87, 88, 90

(56) References Cited

U.S. PATENT DOCUMENTS

| | | | | | |
|---|---|---|---|---|---|
| 1,786,537 | A | | 12/1930 | Holek | |
| 2,834,137 | A | | 5/1958 | Kunz | |
| 3,939,590 | A | | 2/1976 | Musgrave | |
| 4,291,483 | A | | 9/1981 | Musgrave | |
| 4,442,962 | A | * | 4/1984 | Musgrave | 224/255 |
| 4,538,371 | A | | 9/1985 | Howard | |
| 4,574,511 | A | | 3/1986 | Csongor | |
| 4,614,052 | A | | 9/1986 | Brown | |
| 4,706,402 | A | | 11/1987 | Csongor | |
| 4,719,715 | A | * | 1/1988 | Howard | 42/87 |
| 4,799,323 | A | * | 1/1989 | Musgrave | 42/90 |
| 5,301,449 | A | * | 4/1994 | Jackson | 42/87 |
| 5,377,436 | A | * | 1/1995 | Switzer | 42/87 |
| 5,417,003 | A | | 5/1995 | Claveau | |
| 5,669,171 | A | | 9/1997 | Sally | |

FOREIGN PATENT DOCUMENTS

| | | | | |
|---|---|---|---|---|
| AT | 129887 | * | 10/1932 | 42/88 |
| GB | 555367 | * | 8/1943 | 42/87 |

OTHER PUBLICATIONS www.hecklerkoch–usa.com/pages/ri_loader556.html 1 page Item B,A Jul. 2001.
www.hecklerkoch–usa.com/pages/sm_9loader.html 1 page Item B,A Jul. 2001.
www.hecklerkoch–usa.com/pages/ri_loader762.html 1 page Item B,A Jul. 2001.
www.hecklerkoch–usa.com/pages/g36_mags.html 1 page Item A,B Jul. 2001.
www.betaco.com/cmag_m16_catalog_view.htm 1 page Item LCMS10 Jul. 2001.
www.betaco.com/cmag_m16_catalog_new.htm 1 page Item LCMP05 Jul. 2001.
www.vectorarms.com/accessoriesUZI.htm 1 page "speed-loaders" Jul. 2001.

* cited by examiner

*Primary Examiner*—Stephen M. Johnson
(74) *Attorney, Agent, or Firm*—David Pressman

(57) ABSTRACT

A fiream magazine loader and unloader accessory (10) comprises a main body (12) adapted to fit over an open end of a magazine (70) and a tiltable alternate round thruster (50) mounted in the main body above the magazine's open end. The alternate round thruster includes two plungers (62) and (64), each positioned above a column of rounds (80, 82) of the magazine. Loading is achieved by thrusting inside the magazine the topmost round of the magazine using the plunger above to provide a vacant space for a new round to be rearwardly inserted. Unloading is achieved by thrusting inside the magazine the second-to-topmost round of the magazine with the plunger above to release spring (78) pressure from the topmost round so that it can gravitationlly and forwardly unload.

23 Claims, 8 Drawing Sheets

MAGAZINE LOADER AND UNLOADER ACCESSORY

CROSS-REFERENCE TO RELATED APPLICATIONS

This application claims the benefit of U.S. Provisional Patent Application Ser. No. 60/221,393, filed Jul. 23, 2000, now abandoned.

BACKGROUND OF THE INVENTION

1. Field of Invention

The invention relates to firearms, particularly to a method and accessory for facilitating loading and unloading of firearm rounds into and out of a firearm magazine.

2. Prior Art

Many small firearms, including assault rifles and submachine guns, utilize and fire rounds (also known as ammunition). Each round is substantially elongated and comprises a cuplike case or cartridge, usually of brass, which is filled with an explosive propellant. At its rear or closed end, the cartridge has a rim or flange containing a primer; the front and opposite end of the cartridge is open. A bullet, slug, or head, usually of lead (optionally jacketed) is partially inserted into the open or front end of the cartridge by crimping the cartridge onto the bullet. When the round is fired, the primer is ignited by a percussive force, and it in turn ignites the propellant, which explodes and forces the bullet out of the cartridge at a high rate of speed.

The rounds are held within and fed into the firearm from a magazine (also known as a clip). A detachable magazine has become dominant throughout the world. The term 'magazine' is broad, encompassing several geometric variations, including curved magazines. Most detachable magazines are similar, varying in form and structure, rather than in their general principles of operation.

Magazines usually take the form of an elongated container having a generally rectangular cross-section, which is attached to the underside of the firearm. They are commonly made of aluminum alloys, plastic, or steel. They are usually closed on five sides and open on a sixth, upwardly facing side or end, and are substantially hollow. The open side has a rectangular end and includes two round-retaining members, known as lips. Magazines have an internal spring, which urges a follower (blank piece of plastic or metal) toward the open side. The follower in turn urges the rounds as a group up against the lips. The lips act as a stop for the rounds so that they are not expelled from the magazine. The firearm's chambering mechanism then picks off the rounds individually and transports them to a chamber where they are fired by a firing pin, under control of the user.

Rounds are stacked or oriented in one or two columns in the magazine such that the longitudinal axes of the rounds are substantially parallel and perpendicular to the direction of travel of the spring and follower. Adjoining rounds are oriented side-by-side, i.e., the bullets of adjacent rounds are next to each other, as are the cartridges.

In magazines that contain two adjacent columns, the rounds are stacked in a staggered (zigzag) fashion. Such magazines achieve higher round capacity compare to single column magazines.

Magazines of handguns or pistols contain either a single column of rounds, for smaller pistols, or, for larger pistols, two staggered columns, which converge to a single column at the open end of the magazine. Such magazines expose just a single, topmost, round, between both lips. These handgun magazines are not relevant here.

Magazines of assault rifles and submachine guns, such as the AR15/M16, AK47/74-Kalashnikov, FAL, MP5, G36, Galil, Uzi, etc., are double-stacked, i.e. they contain two staggered columns throughout the magazine to allow higher round capacity. At the top of the magazine, the lips alternately retain the left and right topmost round, as the rounds are fed up and picked off. In contrast to the above handgun magazines, two rounds are exposed between the lips.

Prior to use, a firearm magazine must be loaded (charged or filled). When a magazine is being loaded, it is necessary to depress all previously loaded rounds before an additional round can be loaded. Each time another round is loaded the spring is further compressed, requiring more insertion force. When a magazine is fully loaded, the spring is fully compressed and exerts maximum upward force.

Loading magazines is a relatively time-consuming and tedious practice. When a plurality of magazines are to be loaded, much time is required, shortening reposing, training, or combat time. In combat circumstances, slow reloading can be life-threatening.

Storage of a fully loaded magazine for an extended period of time may result in metal fatigue in the compressed spring, causing it to weaken or "relax". Thus, the next time the magazine is used in a firearm, the spring force may be insufficient to feed rounds rapidly into the firearm.

Hence, unless one intends to use a loaded magazine, it is desirable to unload all the rounds. Also, in many jurisdictions the transportation of a loaded magazine is unlawful due to hazards involved. Furthermore, unloading magazines is further required for magazine cleaning, repair, training, and overall safety. Still further, some internal military procedures require that each and every loaded magazine be periodically unloaded and reloaded for general inspection of the rounds and magazine, and to decompress the spring.

Several prior-art methods for unloading and loading double-stacked magazines are as follows:

Magazine Unloading: A first method of unloading a magazine is to apply force, usually with the thumb or another handheld round or tool, to the rim of the topmost round, pushing it forward until it slips pass the retaining lip and out of the magazine. While the magazine is being unloaded this way, it is necessary to overcome friction between the topmost round and the retaining lip that secures it, as well as friction between this round and the rounds below it. The spring force causes this friction. The drawbacks of this unloading method are as follows: (1) Using bare fingers to handle rounds against friction of the spring often is painful, especially where the same finger, usually the thumb, is used to unload many rounds. (2) It is slow, cumbersome, and generally unsafe.

U.S. Pat. No. 5,417,003 to Claveau, May 23, 1995, describes a general tool for loading and unloading magazines. FIG. 16 illustrates the use of this tool, which aids in the above first unloading method. However, this tool is uncomfortable and slow in use.

A second unloading method is to apply an inward thrust to the second-to-topmost round of the magazine, thrusting it and all the rounds below it toward the bottom of the magazine. Such thrust on the second round releases the force on the topmost round, so that it may be gravitationally and forwardly released from the magazine. This action may be repeated until the magazine is fully discharged.

U.S. Pat. No. 3,939,590 to Musgrave, Feb. 24, 1976, describes a device for emptying a magazine conforming to above second unloading method. However the device is uncomfortable and slow to use. Further, no facilitation of loading is mentioned.

The Claveau patent illustrates in FIGS. 17 and 18 its implementation of the above second unloading method. However, this tool is still uncomfortable to use.

A third unloading method is to initially thrust the second round from the top down so as to release the topmost round, as in the second method above. Then, to limit elevation of all the rounds but the topmost round so that the latter may be released from the magazine, gravitationally and forwardly.

This method is implemented by the Heckler & Koch (H&K) Company of Germany, which provide 5.56 mm, 7.62 mm, and 9 mm magazine unloaders for their submachine guns magazines, found respectively at item B of each of the following sites:

http://www.hecklerkoch-usa.com/Pages/sm_9loader.html,
http://www.hecklerkoch-usa.com/Pages/ri_loader556.html,
and
http://www.hecklerkoch-usa.com/Pages/ri_loader762.html.

These unloaders utilize a single protrusion which, by user control, is swung between the two columns of rounds. This engages the second-to-topmost round and thereby limits the elevation of the rounds. However, these unloaders cannot perform loading of rounds.

While the second and third unloading methods above are efficient, most users improvise on these, usually by using a single round or some handy protrusion to engage the second-to-topmost round. This incurs the following drawbacks: (1) Using a round as a tool, or some other improvised tool, to thrust against another round is generally unsafe, (2) Such action often causes a deformation of the magazine's lips, its rounds, or both. Such a deformation may later cause a malfunction with the firearm's operation, which can be life-threatening during combat. (3) Where deformation of the lips occurs, it usually renders the magazine obsolete, costing military and law enforcement agencies large sums of money yearly to replace such magazines.

Magazine Loading: The prior art shows just a single loading method for double-stacked magazines. This is the straightforward "push-down" method. The user places one or more rounds longitudinally in parallel with and between the lips of the magazine. Then the round(s) are successively forced inside the magazine, thrusting down the topmost round to slip past the retaining lips, to be locked by them. The user may perform this method with bare fingers. However, the drawbacks are as follows: (1) Using bare fingers to handle rounds against the spring pressure often is painful, usually where the thumb is repeatedly used. As more rounds are loaded, increased loading force is required against the compressed spring. Pain intensifies if multiple magazines are loaded, if the weather is cold, or if loading is done with injured fingers. (2) Bare finger loading is slow and cumbersome, especially with an untrained user.

The prior art shows numerous attempts to provide adequate magazine loaders using this method. They basically fall into two categories: (1) accessories for loading bound rounds, and (2) accessories for loading loose rounds.

In the first category, accessories for loading bound rounds, as with the common 10-round metal or plastic retainer strips (also called stripper clips), are shown in the following references: U.S. Pat. No. 4,291,483 to Musgrave, Sep. 29, 1981; U.S. Pat. No. 4,538,371 to Howard, Sep. 3, 1985; U.S. Pat. No. 4,574,511 to Csongor, Mar. 11, 1986; U.S. Pat. No. 4,706,402 to Csongor, Nov. 17, 1987; and U.S. Pat. No. 5,669,171 to Sally, Sep. 23, 1997.

Further, The Beta Company of Georgia, and H&K, above, show, at the respective sites, http://www.betaco.com/cmag_m16_catalog_new.htm (item LCMS10), and http://www.hecklerkoch-usa.com/Pages/g36_mags.html (item "A")

a "Speed Loader" accessory for loading 10-round retainer strips. They load one 10-round strip at a time using a plunger.

Using such bound-round loaders has its advantages and disadvantages, as is known in the art. However, these are not material here.

The second category-accessories for loading loose rounds-again uses the simple push-down method. The following are prior-art examples:

U.S. Pat. No. 1,786,537 to Holek, Dec. 30, 1930 describes an apparatus for filling magazines with loose rounds using a special receptacle for the rounds. However, this device is large in size, slow to use, and comprises many parts.

U.S. Pat. No. 2,834,137 to Kunz, May 13, 1958, the Howard patent, supra, and a similar loader accessory by IMI Israel, found at the following site: http://www.vectorarms.com/accessoriesUZI.htm ("SPEEDLOADERS" section, item "9 mm, speed loads") all describe a magazine loader for loading a group of loose rounds into a magazine, using the push-down method. However, these devices are large in size and require direct force against the spring to load.

Further, The Beta Company and H&K, at the respective sites, http://www.betaco.com/cmag_m16_catalog_new.htm (item LCMP05), and http://www.hecklerkoch-usa.com/Pages/g36_mags.html (item "B")

provide devices for loading a plurality, usually five to ten, loose rounds. Rounds are dropped into the body through a side hole, and are simultaneously pressed into the magazine using a top plunger. Again, these devices are large in size and require direct force against the spring to load.

A "Thumbsaver" loader accessory for a single round is made by IMI and is found at the site http://www.vectorarms.com/accessoriesUZI.htm "SPEEDLOADERS" section, item "Thumbsaver .45 caliber", and also item "Thumbsaver .22 caliber".

These accessories function only as simple loaders which use direct force against spring pressure.

U.S. Pat. No. 4,614,052 to Brown et al., Sep. 30, 1986, describes a magazine loader for loading a plurality (usually 15–20) of loose rounds in a one-stroke transfer. This loader is quite large in size and weight, comprises many parts, and requires direct force against the spring to load.

Further, H&K provides 5.56 mm, 7.62 mm, and 9 mm magazine loaders, found at item A of the sites, http://www.hecklerkoch-usa.com/Pages/sm_9loader.html
http://www.hecklerkoch-usa.com/Pages/ri_loader556.html,
and
http://www.hecklerkoch-usa.com/Pages/ri_loader762.html for their range of submachine gun magazines. These comprise an internal plunger which thrust down a round placed above and between the lips. However, these loaders cannot perform unloading.

The prior art describes many other loaders adapted only for magazines of handguns and pistols. Again, these are not relevant to this application because such magazines expose just a single round between their lips.

In summary, bare finger loading or unloading is tedious, cumbersome, and injurious. While several accessories have been provided for facilitating such chores, none are able to load and unload loose rounds into a magazine efficiently, rapidly, safely, and easily.

Objects and Advantages

Accordingly, several objects and advantages of the invention are to provide (a) a single accessory for both loading and unloading loose rounds of a magazine, (b) a loader-unloader which is workable at high speed with minimal fatigue to a user's fingers, (c) a durable loader-unloader that is simple to operate in tough, varying, military conditions, (d) a low-cost, pocket-size, lightweight loader-unloader comprising few parts and which is small and durable, (e) a loader-unloader which military and law-enforcement agencies can afford to issue it to their numerous users to save on replacement magazines with ruined lips caused by inefficient and improvised loading and unloading, and (f) a variety of such loader-unloaders which can be made to match different sizes magazines and rounds.

Still further objects and advantages will become apparent from a consideration of the drawings and ensuing description.

SUMMARY

An accessory and method for facilitating both loading and unloading of loose rounds into or out of a firearm magazine basically comprises two parts: a body adapted to fit and lock over an open side of a magazine, and a tiltable Alternate Round Thruster (hereafter ART) adapted to push or thrust rounds into the magazine. The ART includes two spaced plungers, each positioned above a column of rounds. The accessory is fitted and locked to the magazine prior to use. For loading, the magazine is held with its front edge facing substantially upward towards the user. The ART is tilted to a first end position where a plunger presses either the follower of the magazine, if empty, or the topmost round of the magazine, if partially-loaded. A vacant space is then provided below the lips of the magazine for the user to rearwardly insert a new round. The ART is then tilted to a second, opposite, end position for the other plunger to press inside the last inserted round, and all previously loaded rounds, and to provide a new vacant space. For each ART end position, one round is loaded. Hence, the ART is repeatedly tilted up-and-down between the two end positions as rounds are loaded and until the magazine is full. For unloading, the magazine is held substantially horizontal in a manner where its front edge facing downward. The ART is then repeatedly tilted up and down between the two end positions for the plungers to alternately thrust the second-to-topmost rounds of the magazine, thus allowing the topmost rounds to gravitationally free-fall out of the magazine. One round is unloaded for each ART end position. Further, the accessory allows loading and unloading under a reduced force due to the leverage of the ART.

DRAWINGS

Figures

DRAWINGS

Reference Numerals

Figure 1A:
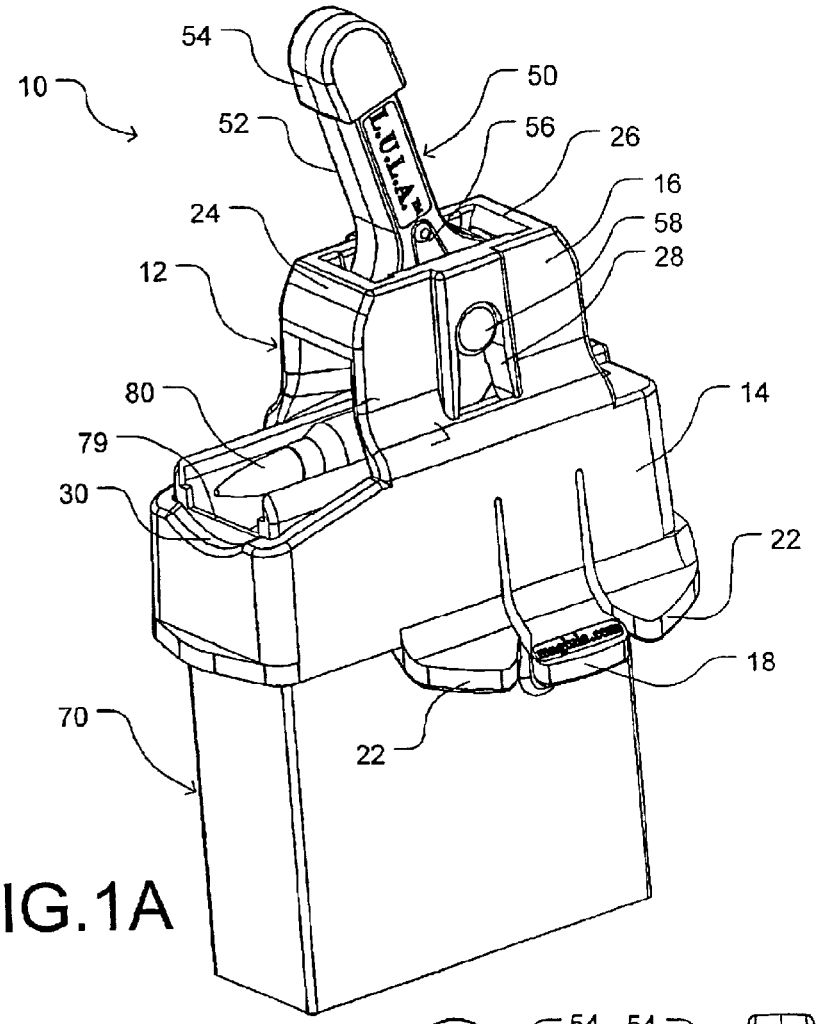
FIG. 1A is a perspective view of an AR15/M16 type magazine Loader and UnLoader (hereafter Loader) Accessory (LULA™) coupled to a magazine, in accordance with the invention.

10 Loader (Loader and UnLoader Accessory)
12 main body
14 lower portion
16 upper portion
18 tongue
20 tooth
22 guard protrusion
24 front stop
26 rear stop
28 side opening

30 front top edge
32 inner curves
34 inner flat portion
50 ART (Alternate Round Thruster)
52 operating handle
54 crown
56 flexible bulge
58 pivot bar
60 center section
62 first plunger
64 second plunger
70 magazine
71 magazine lock hole/depression
72 left lip
74 right lip
76 follower
78 spring
79 magazine front top edge
80, 82, 84, 86 rounds
150 alternative ART with unequal plungers
162 first plunger of ART with unequal plungers
164 second plunger of ART with unequal plungers
250 alternative ART with four plungers
252 crank
253 finger grip
258 pivot bar of ART with four plungers
262 plungers of ART with four plungers
300 Loader for Kalashnikov/Galil (K/G) type magazine
312 main body of Loader for K/G type magazine
321 front lock rim
350 alternative ART with wheel plungers
358 pivot pin
359 pivot hole
364 wheel
365 ART tab
450 alternative side-to-side ART
452 operating handle of side-to-side ART
455 elongated openings
458 pivot bar of side-to-side ART
459 pivot pins
462 first up-down plunger
464 second up-down plunger
466 guide

DETAILED DESCRIPTION

Preferred Embodiment

FIGS. 1A-1D

The following describes a preferred embodiment of a Loader designed to fit an AR15/M16 type firearm magazine, as the common 30 round USGI type, adapted for holding NATO's 5.56 mm rounds. The Loader and magazine are held vertically upward, as shown in FIG. 1A. The Loader is designed for low-cost mass-production plastic injection molding where the preferred plastic material is glass-fiber reinforced polyamide (nylon) 6 (or 6/6 or 12), which is durable and substantially resistant to gun oil and other chemicals.

For other types of firearm magazines, as the Kalashnikov, FAL, MP5, Galil, Uzi, etc., a somewhat modified Loader is used due to different magazine dimensions, the rounds selected, and arrangement of the lock mechanism of the magazine. However, the same basic construction and methods of operation apply.

FIG. 1A shows a perspective view of a Loader 10 operatively coupled to a magazine 70 at its open side. The magazine is shown loaded with a round 80, which is currently the topmost round.

Loader 10 comprises two basic parts: a main body 12 and an alternate round thruster (ART) or depressor 50. Main body 12 comprises a substantially hollow skirt-like member having a substantially rectangular lower portion 14 and an upper portion 16. Lower portion 14 is defined by four walls, an open bottom, and a substantially open top. The lower portion is dimensioned and configured to closely fit over the open side of the magazine in just one position, with its front and rear to the front and rear, respectively, of the magazine. The front wall of the lower portion has a top edge 30, shown incurvate, dimensioned to be below a front top edge 79 of the magazine.

The Loader includes a mechanism for locking it to the magazine. The mechanism is operationally similar to a firearm's locking mechanism. It comprises a tongue 18 and an internal tooth 20 (shown enlarged in FIG. 2D). Tongue 18 extends from lower portion 14 and is partially defined by two cuts along its sides. It outwardly extends at its distal end and is sized to accept a user's finger from within. The side cuts give the tongue flexibility so that it can be bent away from the magazine under outward force to its distal end.

FIG. 1A further show two guard protrusions 22 adapted to protect tongue 18 from accidental inward, outward, or side force should the Loader be dropped or stepped upon. They extend alongside the tongue and conform to its curvature near its distal end.

Upper portion 16 extends upwardly from lower portion 14. It includes two identical and parallel sidewalls or surfaces connected at their upper comers by a front stop 24 and a rear stop 26. Further, an elongated vertical side opening 28 is provided in each sidewall, generally comprising a straight elongated neck topped by a semicircle bow and having an open bottom inner to upper portion. A pivot bar 58 of the ART is adapted to fit closely in the side openings and is perpendicular to the parallel sidewalls.

Below front stop 24 and rear stop 26 and extending to lower portion 14 are front and a rear openings, respectively. The front opening allows passage of the rounds to the open side of the magazine, and the rear opening is used for better viewing inside, and for cleaning access (see also FIG. 2C).

Figure 1B:
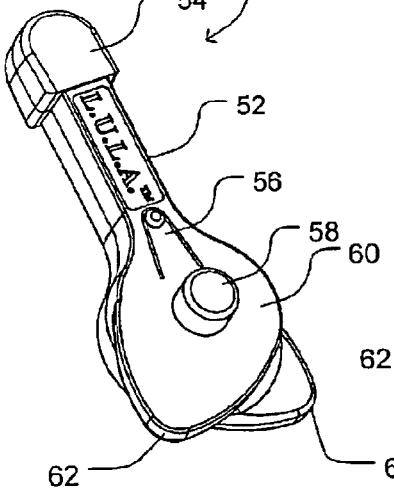
FIG. 1B is a perspective view of an ART of the Loader.

FIG. 1B is a perspective view of ART 50. It comprises a center section 60. Pivot bar 58 extends from and is perpendicular and substantially centered with respect to section 60. ART 50 also includes a bar or operating handle 52 topped by a crown 54, a flexible bulge 56, and two plungers or cams 62 and 64. Plungers 62 and 64 are parallel and have substantially equal dimensions and geometry and each has a smoothed rounded tip and a curved round-thrusting bottom surface integral with the tip.

Figure 1C:
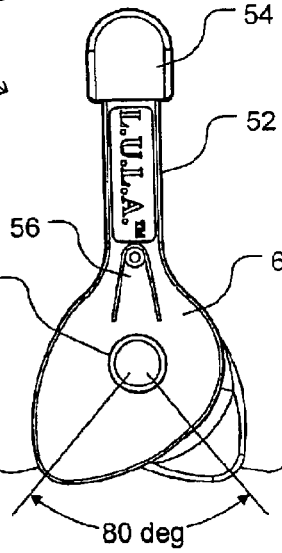
FIG. 1C is a side view of the ART.
Figure 1D:
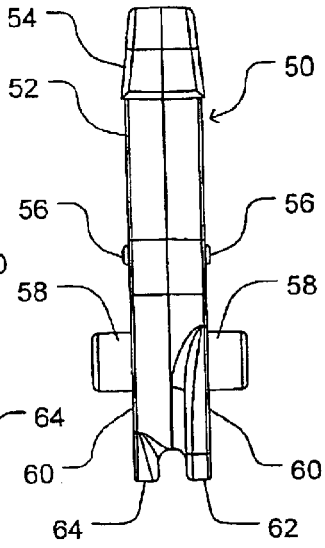
FIG. 1D is a front and rear view of the ART.

FIG. 1C shows a side view of ART 50 and FIG. 1D shows its front and rear view. As shown, crown 54 has two inclined flat surfaces, one on each side of the ART, where the top of the crown is slightly narrower than the width of handle 52, and its lower side is slightly wider than the width of the handle. This allows the ART to be forced upwardly inside upper portion 16 of the body when the Loader is first assembled. It also prevents the ART from ever dropping out of the body (see FIG. 6B). The ART normally fits with either of its sides within upper portion 16, i.e., it is side-interchangeable. The ART is preferably hollow inside.

FIG. 1C further shows that the angle between the center distal part of the plungers—the tips—is 80 degrees where the center of pivot 58 is the vertex. FIG. 1D further shows flexible bulges 56 slightly extending from the width of the ART. These bulges are adapted to retract inside the ART—being hollow, under external force.

Figure 3A:
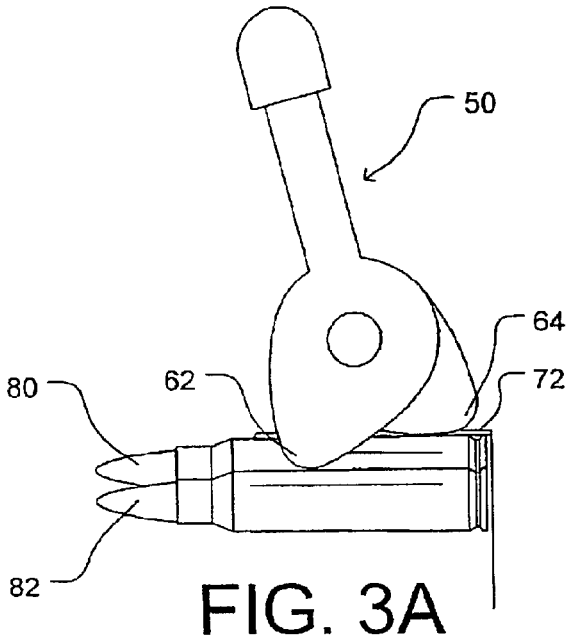
FIG. 3A is a simplified side view of the ART in a forward neutral position.
Figure 3B:
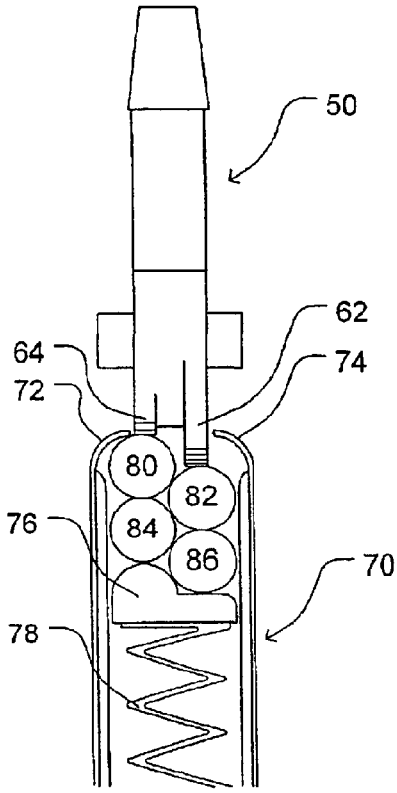
FIG. 3B is a simplified front view of the ART in the forward neutral position.

The ART and its plungers are positioned above the rounds of the magazine for operation, such that the plungers will pass or extend between the lips of the magazine to contact the cartridges of the rounds (see FIG. 3B). The ART, or more specifically pivot 58, is further positioned vertically above the approximate midpoint of the length of a cartridge of a round in the magazine. The ART is mounted in main body 12 by pivot bar 58 that is perpendicular to the rounds below.

FIGS. 2A-2D

Figure 2A:
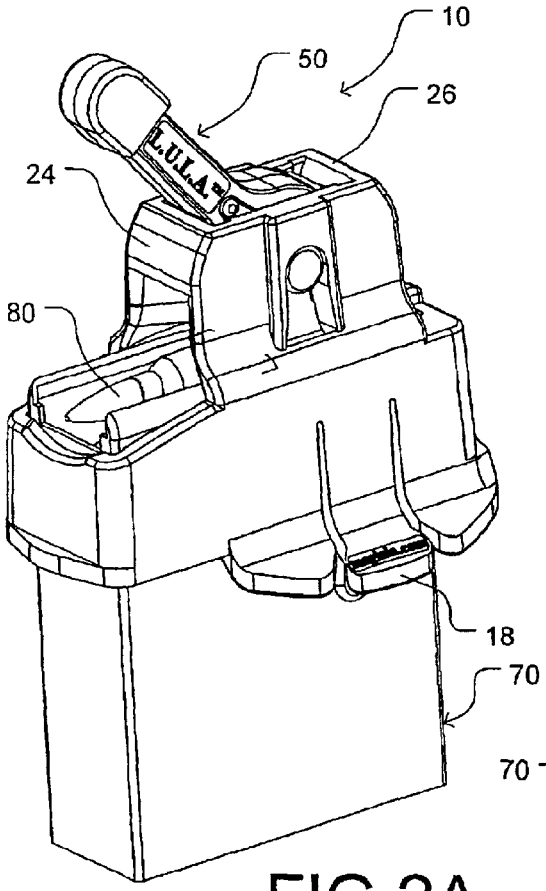
FIG. 2A is a perspective view of the Loader and magazine with the ART in an extreme forward position.

FIG. 2A is a perspective view of the Loader coupled to the magazine with the ART at an extreme forward position.

Figure 2B:
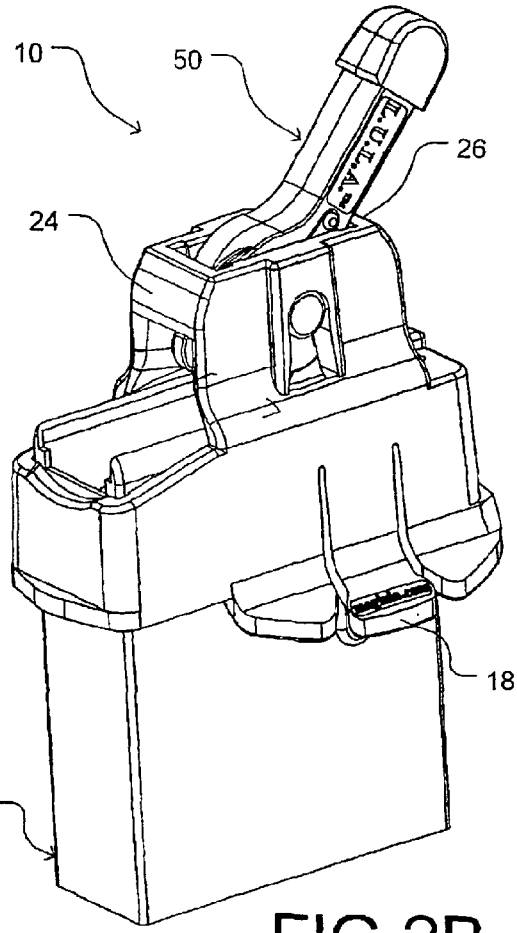
FIG. 2B is a perspective view of the Loader and magazine where the ART is shown at an extreme backward position.

FIG. 2B is a perspective view of the Loader coupled to the magazine with the ART at an extreme backward position.

An extreme ART position is defined as a position where the ART is maximally tilted or pivoted to engage either front stop 24 (FIG. 2A) or rear stop 26 (FIG. 2B). The current Loader design allows the ART to tilt 80 degrees between the two stops.

Figure 2C:
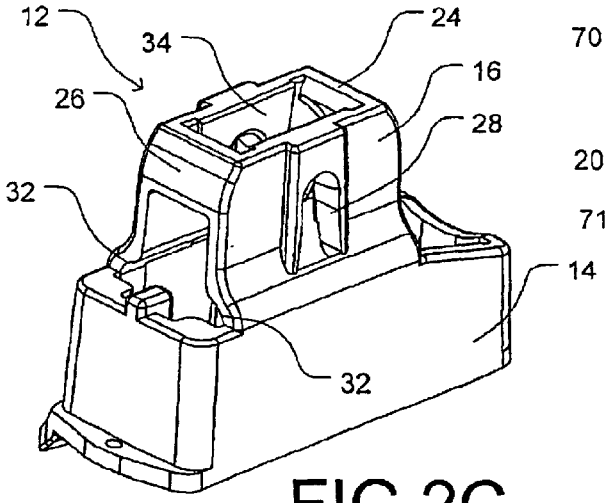
FIG. 2C is a perspective rear view of the Loader's body.

FIG. 2C is a perspective rear view of body 12, showing the rear opening below rear stop 26. Two inner curved portions 32 are designed substantially to parallel the lips of the magazine (not shown) to keep a small gap above them. The curved portions extend to the inner front of upper portion 16. Thus when a magazine is installed, there is no contact between the Loader and the lips. Further, each sidewall of upper portion 16 includes an inner flat and parallel portion 34 to keep the ART from jiggling sideways.

Figure 2D:
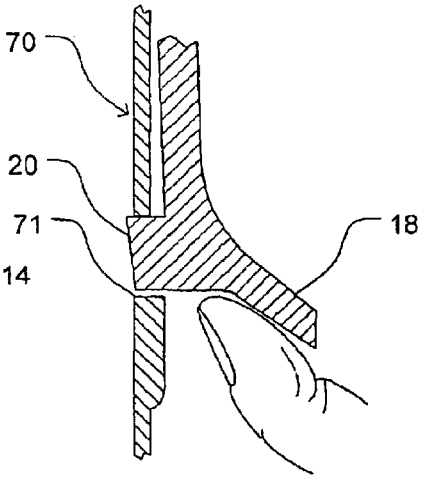
FIG. 2D is an enlarged cut view portion of a lock mechanism of the Loader.

FIG. 2D shows an enlarged cutaway view portion of the Loader coupled to magazine 70. Lock tooth 20 extends inwardly from the internal side of tongue 18 and is sized and located to snap into a lock hole or depression 71 of the magazine, thus securing the Loader to the magazine. The dimensions and position of lock hole or depression 71 of a magazine of the same type firearm is standard among manufacturers.

FIGS. 3A-4F

FIG. 3A to FIG. 4F are simplified drawings that show ART 50 in respect to the rounds of magazine 70, absent main body 12.

FIGS. 3A to 3D illustrate two neutral ART positions. At a neutral position both plungers simultaneously engage the rounds immediately below, and provide a minimal thrust on such rounds. Two such positions exist, a forward neutral position, and a backward neutral position.

FIG. 3A is a simplified side view of ART 50 and rounds 80 and 82 of the magazine, where the ART is at a forward neutral position. Such a position is at equilibrium since both plungers engage the cartridges of the rounds immediately below, i.e., plunger 62 engages round 82 and plunger 64 engages round 80. Topmost round 80 is shown also engaging a lip 72 of the magazine.

FIG. 3B shows a simplified front view of ART 50 and magazine 70 where the ART is at a forward neutral position. The magazine is shown filled with four rounds 80, 82, 84 and 86, with left lip 72 substantially engaging topmost round 80. The magazine further includes a right lip 74, a follower 76, and a spring 78 for exerting an upward pressure on the rounds towards the lips.

The width of ART 50, or more specifically the distance between outer sides of plungers 62 and 64, is sized to fit between the lips of the magazine. Further, each plunger is positioned above a column of rounds in the magazine, and its width is approximately 3 mm.

Note that plungers 62 and 64 engage rounds 82 and 80, respectively.

Figure 3C:
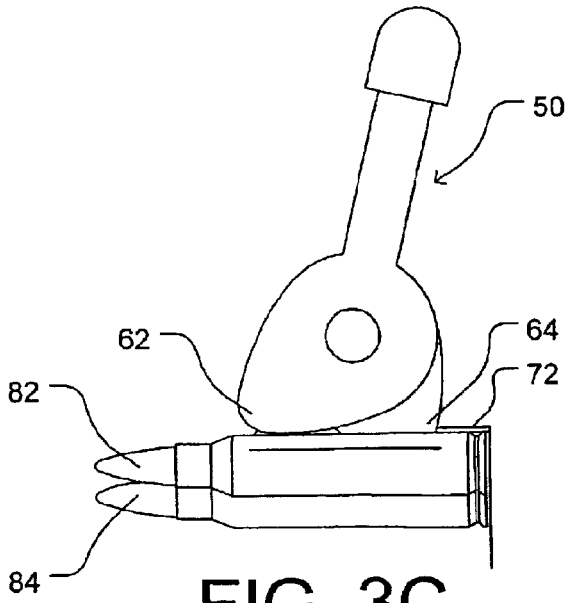
FIG. 3C is a simplified side view of the ART in a backward neutral position.
Figure 3D:
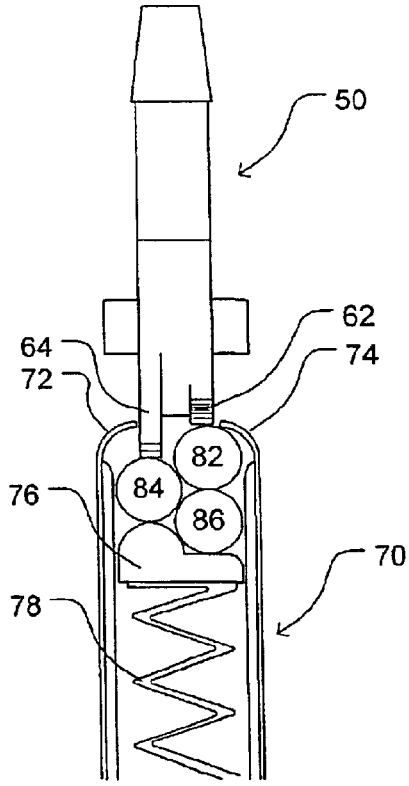
FIG. 3D is a simplified front view of the ART in the backward neutral position.

FIGS. 3C and 3D are similar to FIGS. 3A and 3B, respectively, but here the ART is at a rear neutral position because now topmost round 82 is on the right hand side. Hence, in this second neutral position, plungers 62 and 64 engage rounds 82 and 84, respectively, with right lip 74 engaging topmost round 82.

FIGS. 4A to 4F illustrate the two possible extreme-ART positions.

Figure 4A:
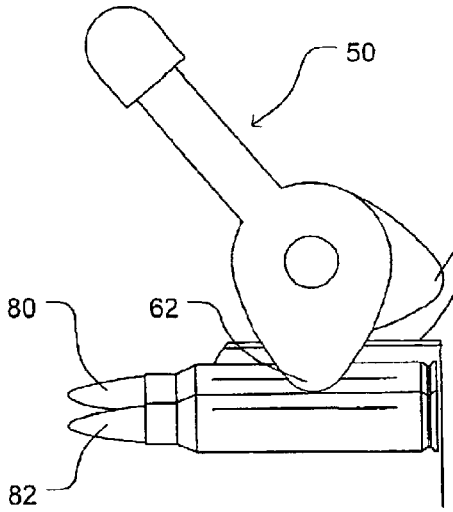
FIG. 4A is a simplified side view of the ART in extreme forward position.

FIG. 4A is a simplified side view of ART 50 and rounds 80 and 82 of the magazine, with the ART at an extreme forward position (as in FIG. 2A). I.e., the ART is tilted or pivoted 40 degrees forward (half of the 80-degree range). At this position the tip of plunger 62 is at its lowest vertical position and engages the cartridge of round 82 beneath it, and the tip of plunger 64 is at its highest vertical position, clear of any round. Topmost round 80 is shown with an approximate gap of 2 mm below lip 72 of the magazine.

Figure 4B:
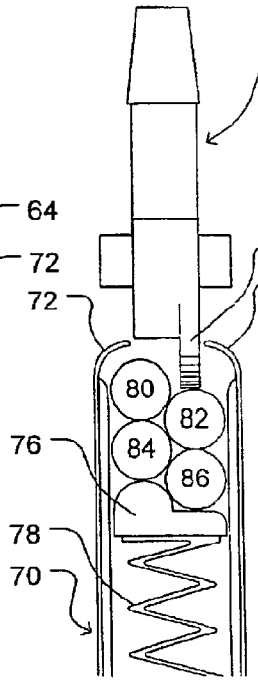
FIG. 4B is a simplified front view of the ART in the extreme forward position.

FIG. 4B shows a simplified front view of ART 50 and magazine 70 where the ART is at its extreme forward position. The magazine is shown filled with four rounds 80, 82, 84 and 86, with plunger 62 at its lowest vertical position, engaging round 82.

Figure 4C:
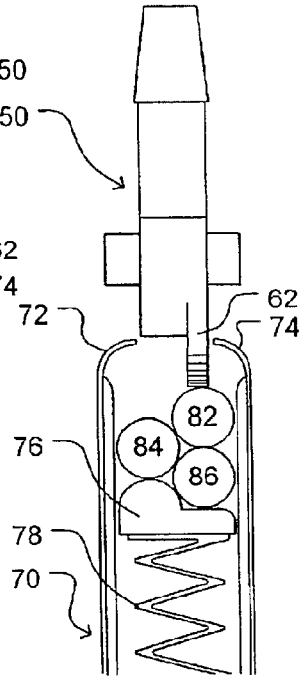
FIG. 4C is a simplified front view of the ART in the extreme forward position with a vacant space in the magazine.

FIG. 4C is similar to FIG. 4B, but here round 80 is absent, so that a vacant space is in its place, to the left of plunger 62.

Figure 4D:
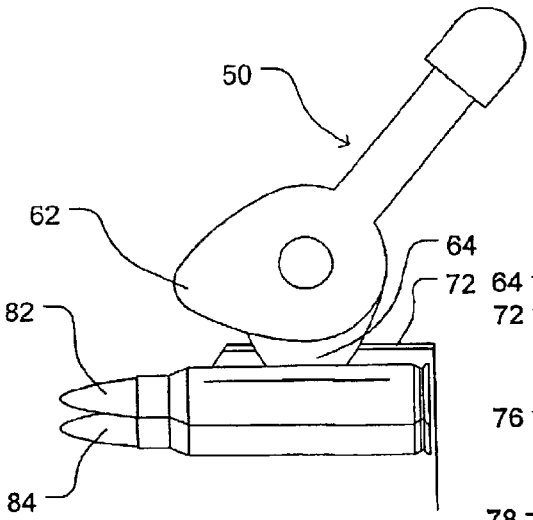
FIG. 4D is a simplified side view of the ART in extreme backward position.
Figure 4E:
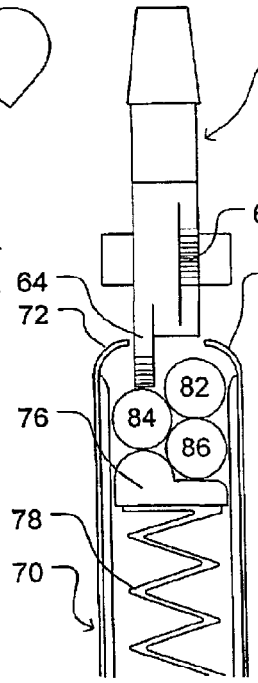
FIG. 4E is a simplified front view of the ART in the extreme backward position.

Similarly when the ART is tilted to extreme backward position as shown in FIGS. 2B and 4D to 4F, the tip of plunger 64 is at its lowest vertical position, engaging round 84 beneath it. The tip of plunger 62 is at its highest vertical position, clear of from any round. Topmost round 82 is shown with an approximate 2 mm gap below lip 74 (FIG. 4E).

Figure 4F:
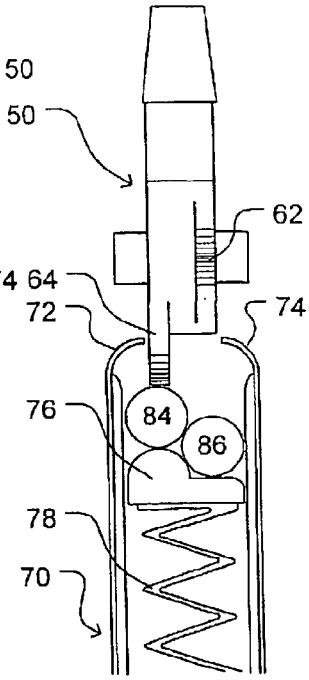
FIG. 4F is a simplified front view of the ART in the extreme backward position with a vacant space in the magazine.

FIG. 4F is similar to FIG. 4E, but where round 82 is absent and a vacant space is in its place, to the right of plunger 64.

The Loader is dimensioned such that when either plunger is at its lowest vertical position, at an extreme ART position, its tip is approximately 7 mm below the lips of the magazine. This distance is the sum of half of the cartridge's diameter and a gap distance of approximately 2 mm, as mentioned above. Further, at its lowest vertical position, the tip of a plunger is vertically below center of pivot 58 of the ART.

FIGS. 5A-6B

Figure 5A:
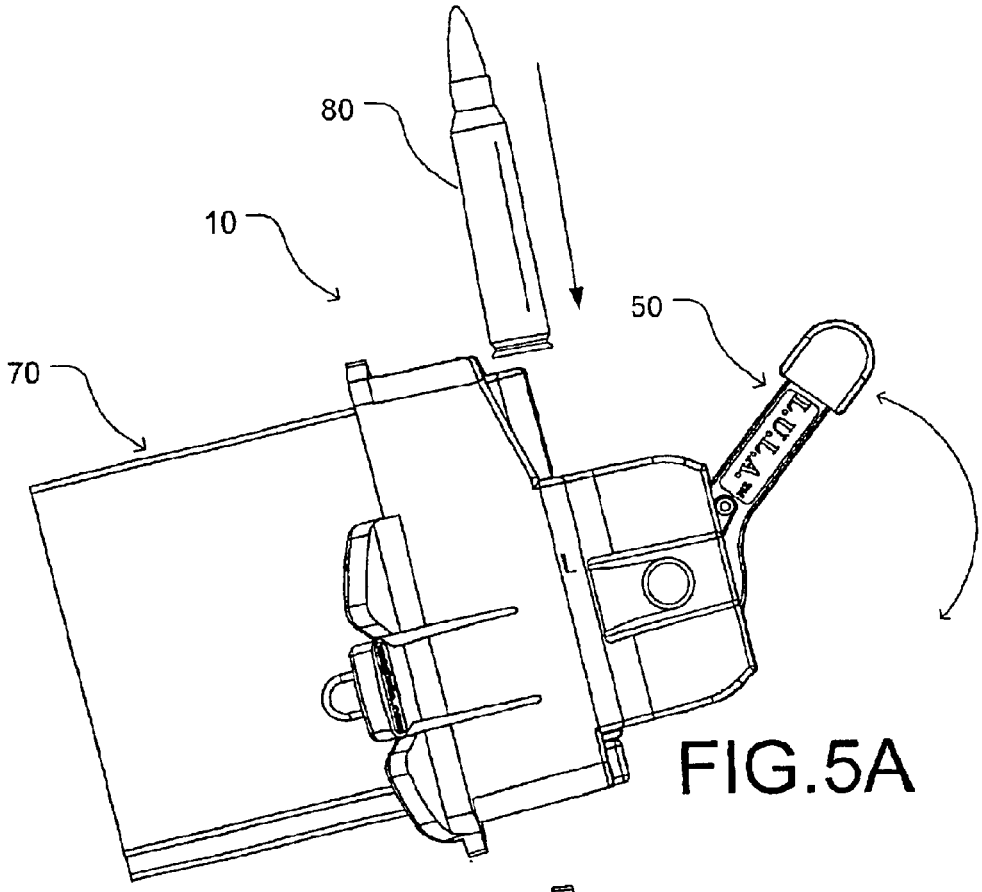
FIG. 5A is the Loader in a preferred loading position.

FIG. 5A is a side view of the Loader and coupled magazine positioned for loading rounds into the magazine. Here the front opening of the Loader faces substantially upward. A single loose round 80 is shown being rearwardly loaded into the magazine.

Figure 5B:
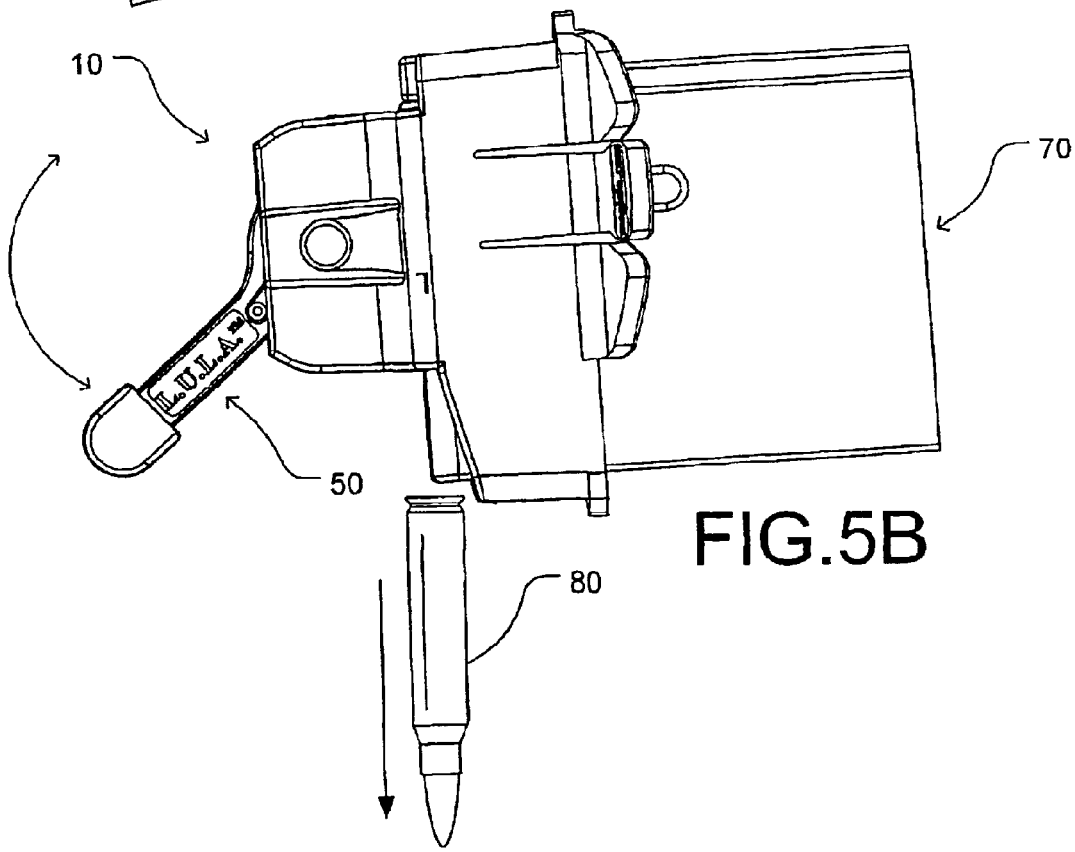
FIG. 5B is the Loader at a preferred unloading position.

FIG. 5B is a side view of the Loader and coupled magazine positioned for unloading rounds from the magazine. Here the front opening of the Loader faces substantially downward. A single loose round 80 is shown being forwardly unloaded and free-falling from the magazine.

Figure 6A:
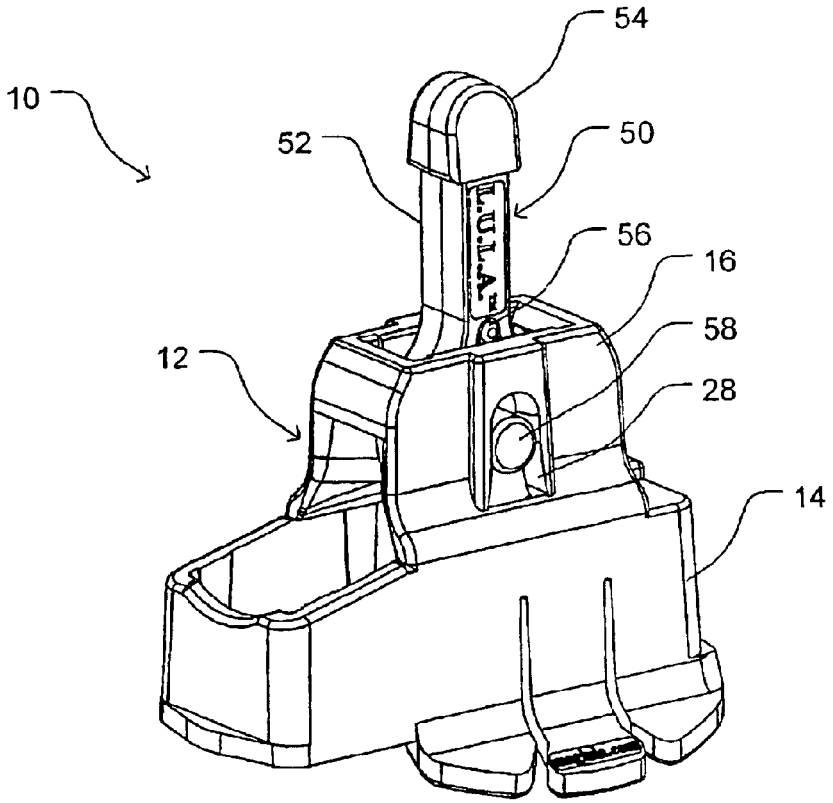
FIG. 6A is a perspective view of the Loader with the ART in a standby position.
Figure 6B:
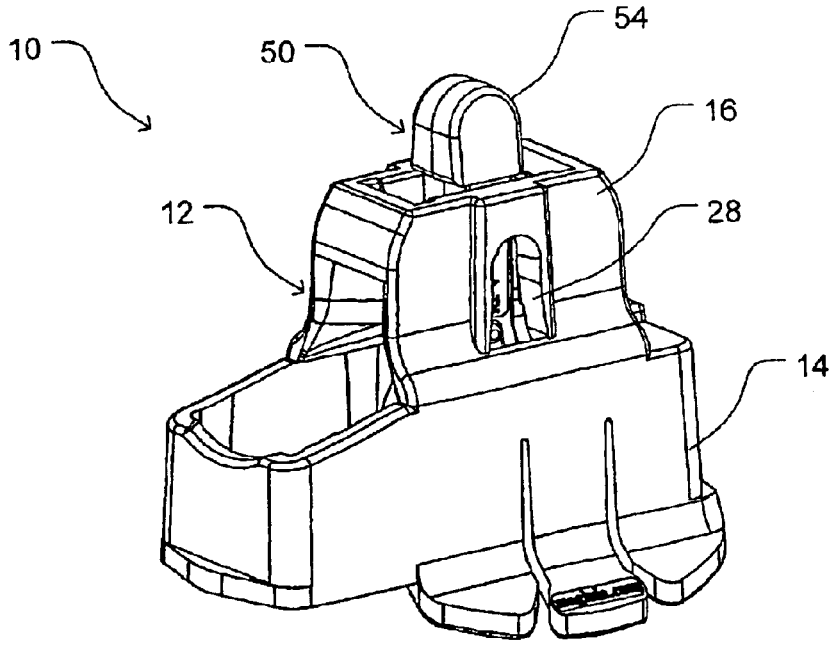
FIG. 6B is a perspective view of the Loader with the ART in a retracted position.

FIGS. 6A and 6B are two perspective views of the Loader detached from the magazine, with the ART shown in two non-operational positions; a standby position and a retracted position.

These positions are possible due to elongated pivot opening 28 and pivot 58 that is downwardly slidable within opening 28.

FIG. 6A shows that, with no magazine installed, the ART is gravitationally retracted by approximately 3 mm into main body 12. Travel of the ART is limited because its two flexible bulges 56 rest on the upper edge of upper section 16. This standby position is automatically achieved between magazine changes; this saves the user the labor of pulling the ART all the way up to an operating position (FIGS. 1A, 2A and B, etc.) from the retracted position of FIG. 6B.

FIG. 6B shows that with no magazine installed, the ART can be retracted into the main body by providing light downward pressure on crown 54. This pushes flexible bulges 56 into the ART and allows handle 52 to retract into the main body. This is due to the fact that the distance between the distal flat plane of pivot 58 on both sides of the ART is slightly less than the inner width of lower portion 14. The ART then rests on the bottom part of crown 54, which is slightly wider than the ART, as previously mentioned. This retracted ART position is useful for minimizing the size of the Loader for transport or storage, and to allow the user to comfortably pocket it. At such position the ART is loose within the body.

OPERATION

Preferred Embodiment

The Loader provides substantial assistance to a firearm user in safely and rapidly loading and unloading a magazine. It may be adapted to operate with any type of double-stacked magazine and with any common rounds.

Unloading a round from the magazine is based on the method of releasing spring pressure from the topmost round of the magazine so that it may fall gravitationally forwardly (bullet first) from the magazine, i.e. free-fall. This is accomplished by providing sufficient thrust into the magazine on the second-to-topmost round, and thus on all previously loaded rounds, for releasing spring pressure from the topmost round, allowing it to unload.

Loading rounds into the magazine is based on the method of providing sufficient vacant space below a magazine's lip for rearwardly (rim/flange first) loading or inserting a round. This is accomplished by providing an inward-thrust on the topmost round of the magazine, and thus on all previously loaded rounds, to lower it sufficiently to create the vacant space.

First, from the retracted ART position of FIG. 6B, the ART is manually pulled upwardly by crown 54 while fitting pivot 58 to upwardly slide inside opening 28. The ART is pulled until it rests on flexible bulges 56, as shown in FIG. 6A. The Loader is then fitted to an open side or end of a matching magazine, front-to-front, so that tooth 20 clicks into hole or depression 71 of the magazine (FIG. 2D), thus firmly locking the two.

While fitting the Loader, the follower or rounds of the magazine automatically push the ART, by its plungers, upwardly from the standby position of FIG. 6A to an operative position. The ART is preferably in one of the two neutral positions of FIGS. 3A and B or FIGS. 3C and D.

In an operative position, and regardless of the ART's angle, the tip of flexible bulges 56 is always above the upper edge of upper-section 16, i.e., it does not obstruct operation.

As mentioned, at a neutral ART position both plungers 62 and 64 simultaneously engage their respective below rounds, if any, each by its round-thrusting bottom surface. Depending upon the plunger's bottom contour, the plungers provide a minimal thrust or push on the rounds of the magazine so that the rounds are at their uppermost position. Hence, the rounds, if any, are predominantly retained in the magazine by engagement with a lip, or by engagement with both plungers, against spring pressure. Any other ART position or angle away from a neutral position causes an increase of thrust on a round by one of the plungers.

Unloading: As mentioned, unloading requires a release of the spring pressure from the topmost round of the magazine so that it may be forwardly unloaded out of the magazine.

From the neutral ART position of FIGS. 3A and B, the user tilts the ART forward to the extreme position of FIGS. 4A-C. Plunger 64 then disengages up from round 80 while plunger 62 slides down along a top portion of the cartridge of round 82, pushing, thrusting or camming it, and hence all the rounds below it, into the magazine. Consequently, topmost round 80 is relieved of spring pressure and will be disengaged below lip 72, leaving an approximately 2 mm gap from the lip. When the Loader is held in the preferred unloading position (FIG. 5B), round 80 then gravitationally forwardly slides over front top edge 79 of the magazine and below lip 72, where it will free-fall out of the magazine.

To unload the next round—round 82—the ART is then tilted to the extreme backward position of FIGS. 4D-F for plunger 62 to disengage up from round 82 and for plunger 64 to slideably engage down on round 84 along a top portion of its cartridge. This will push, thrust, or cam it and all the rounds below into the magazine. Consequently, topmost round 82, being relieved of spring pressure, is disengaged from lip 74, enabling it to gravitationally free-fall forward (FIG. 5B).

As the ART is tilted or pivoted up-and-down, unloading repeats. The plungers will alternately thrust or cam the second-to-topmost round of the magazine until the magazine is emptied.

In practice, the user holds the Loader and coupled magazine in, say, a left hand, where the rounds are directed substantially downwards to earth as in FIG. 5B. The right hand is used to quickly tilt the ART up-and-down between the two extreme ART positions, thus allowing the rounds to free-fall out of the magazine. Hence, every time the ART is moved to an extreme ART position, a single round is unloaded. It takes only approximately 5 seconds to unload a 30-round magazine completely.

Loading: As mentioned, loading requires thrusting the topmost round down to provide sufficient vacant space below a lip to insert a new round rearwardly.

From the neutral ART position of FIGS. 3C and D where a topmost round 82 engages lip 74, the user tilts the ART to extreme forward position (FIGS. 4A-C). Plunger 64 then disengages up from round 84 while plunger 62 slides down along a top portion of the cartridge of round 82, thrusting or camming it, and hence all the rounds below it, into the magazine. Round 82 is now approximately 7 mm below the lips. Consequently, a vacant space is formed below lip 72 next to plunger 62 (FIG. 4C). This space is sufficient to allow the user to rearwardly slide (rim/flange first) a new topmost round 80 over front top edge 79 of the magazine all the way into the vacant space below lip 72 (FIGS. 4A and B).

To load the next round, the user tilts the ART to its extreme backward position, causing plunger 64 to engage down and slide along topmost round 80. This thrusts or cams the round and all rounds below it down, to form a new vacant space (not shown) below lip 74. A new round may now be rearwardly inserted. Further rounds can be loaded by tilting or pivoting the ART up and down between extreme positions and feeding rounds into the vacant space formed below a lip, until the magazine is full. Hence, for each extreme ART position a single round can be loaded.

In practice, the user holds the Loader and coupled magazine in, say, a left hand, where the Loader's front is directed substantially upward (FIG. 5A). At the same time, the user preferably clutches the magazine's opposite closed end against the user's abdomen (not shown). The user employs one or more free fingers of the left hand to tilt the ART up and down between stops as the right hand rearwardly feeds loose rounds. E.g., the user feeds rounds (such as round 80) into the alternating vacant space formed below the lips of the magazine. Hence, every time the ART is moved to its extreme position, a single round can be loaded. The loaded round practically free-falls into the vacant space without any obstruction or effort by the user. It takes only approximately 40 seconds to fully load a 30-round magazine.

Leverage is obtained between handle 52 of the ART and the distal part of a plunger, about pivot 58, due to their difference in length. This leverage reduces the amount of force required to thrust down the rounds against spring pressure relative to the former push-down method. Hence, the user experiences less fatigue.

Note that when the tip of a plunger is at its lowest vertical position it maximally thrusts or cams a round at a point approximately half its cartridge length. This keeps the round(s) substantially level in the magazine. Otherwise, an unleveled, tilted, round(s) may obstruct loading or unloading.

Note that between the two extreme ART positions, where the rounds are maximally pushed down, the rounds are pushed up by the spring to reach their maximum elevation at the neutral positions.

Lastly, after fully loading or unloading the magazine, tongue 18 of the Loader is slightly pulled away from the magazine to disengage tooth 20 from hole or depression 71 of the magazine (FIG. 2D), thereby releasing the Loader. The ART will then be in a standby position (FIG. 6A) for a next magazine to be inserted in the Loader, or the ART may be retracted into the main body for storage (FIG. 6B).

Alternative Embodiments

Several alternative embodiments of the Loader and its parts will now be discussed.

Description

FIG. 7A

Figure 7A:
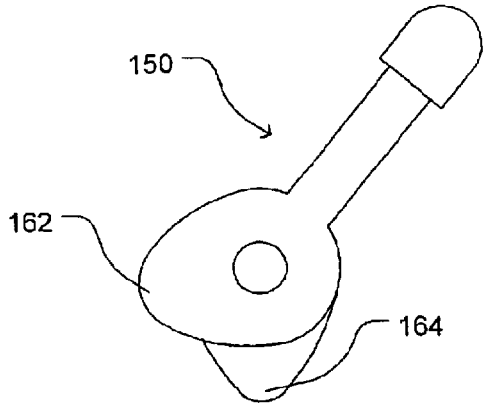
FIG. 7A is a simplified side view of an alternative ART comprising two geometrically-different plungers.

FIG. 7A is a side view of a ART 150 comprising a first plunger 162 and a second plunger 164, which is geometrically different. Such may be the case when providing a Loader for relatively shorter rounds, such as 9 mm rounds usable with MP5s or Uzis. Front plunger 162 is made slightly rounder and/or shorter at its distal (round-thrusting) end to avoid being scraped by the connection edge between the bullet and cartridge (not shown). Also the angle between the plungers may increase to approximately 90 degrees or more to compensate for the roundness and/or shortness of the first plunger. Still, the plungers here thrust the rounds to provide approximately a 2-mm gap between the topmost round and the lip.

Operation

FIG. 7A

The operation of a Loader with a ART 150 as in FIG. 7A is substantially the same as previously described.

Description

FIGS. 7B–C

Figure 7B:
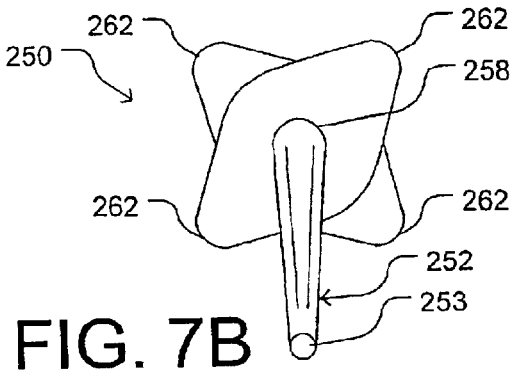
FIG. 7B is a simplified side view of an alternative ART comprising four plungers.
Figure 7C:
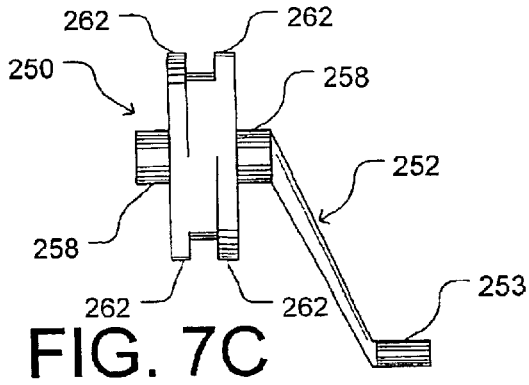
FIG. 7C is a simplified front view of the alternative ART.

FIGS. 7B and 7C show a side and front view, respectively, of an alternative "+" shaped ART 250, comprising four plungers 262 (with multiple round-thrusting bottom surfaces) spaced 90 degrees apart and on alternating sides as shown. The ART includes a side crank 252 and a finger grip 253 for turning the ART about a pivot 258. The body of a Loader with ART 250 is slightly modified-especially upper portion 16 where elongated side opening 28 (FIG. 1A) is closed to encompass pivot 258 and where the stops (24, 26) are eliminated or positioned away.

Operation

FIGS. 7B–C

In FIGS. 7B and 7C, turning the ART in a direction which thrusts the topmost round down facilitates loading of rounds, and turning it in a direction which thrust the second-to-topmost round down facilitates unloading of rounds. Thus, for every 90-degree ART turn, a round can be either loaded or unloaded, depending upon the sequence and the position of the Loader and coupled magazine, as generally illustrated in FIGS. 5A and B.

Description

FIGS. 7D–F

Figure 7D:
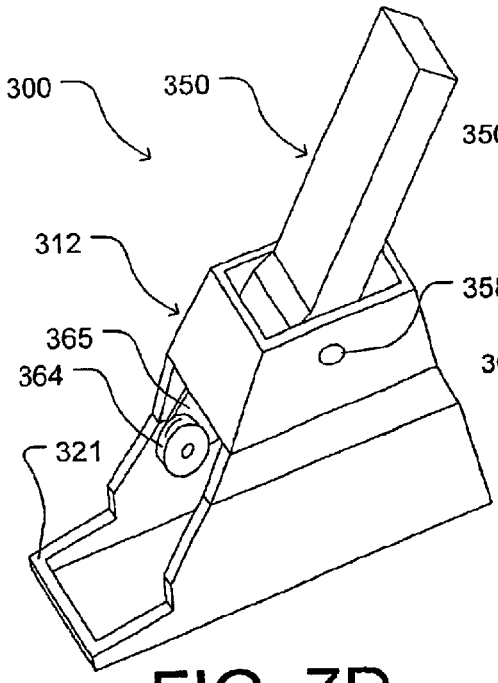
FIG. 7D is a simplified perspective view of a Loader adapted to fit a Kalashnikov/Galil type magazine.

FIG. 7D shows a simplified perspective view of a Loader 300 adapted to fit and operate with a Kalashnikov/Galil (K/G) type magazine. All features of the AR15/M16 type Loader 10 previously described may be used in Loader 300 (or the other way around), except for a suitable dimensional modification and lock mechanism arrangement. The K/G type magazine is sized differently and its lock mechanism has a front and rear protrusions (not shown). A front lock rim 321 is shown for locking underneath the front protrusion of the magazine and a similar, yet flexible rim may be used to lock over the back protrusion of the magazine.

FIG. 7D also shows an alternative ART 350 comprising two revolving wheels or rollers 364 (one wheel is hidden in a body 312) used as plungers; these wheels, which are the round-thrusting bottom surfaces, provide somewhat less friction to the rounds. The wheels revolve or rotate about a center pivot connected by a ART tab 365 to the ART. Further shown is a pivot pin 358 on which the ART tilts. In this example the ART is non-retractable to main body 312, which can also apply to ART 50 previously shown.

Figure 7E:
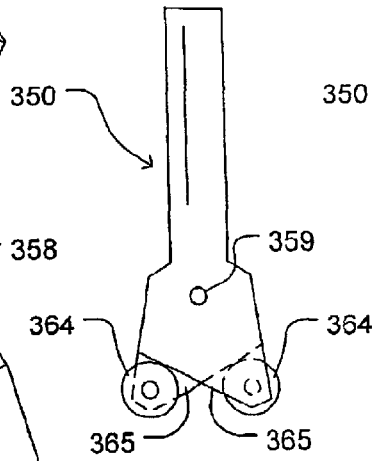
FIG. 7E is a simplified side view of an alternative ART with wheel plungers.
Figure 7F:
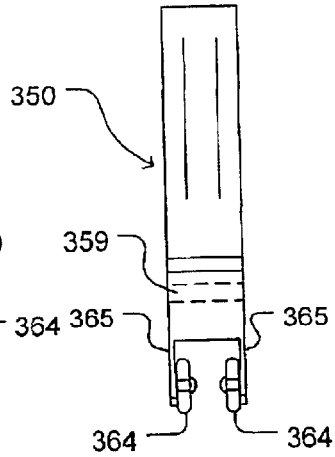
FIG. 7F is a simplified front/rear view of the alternative ART.

FIGS. 7E and 7F are simplified side and front/rear views, respectively, of ART 350. A pivot hole 359 is shown in the ART for pivot pin 358 to pass through. With some dimensional modifications this ART is interchangeable with ART 50, and vice-versa.

Operation

FIGS. 7D-F

The operation of Loader 300 and ART 350 of FIGS. 7D-F are substantially the same as the previously described Loader 10 and ART 50. The wheels of ART 350 roll or rotate over the cartridge of a round, instead of sliding on it.

Description

FIGS. 8A-C

Figure 8A:
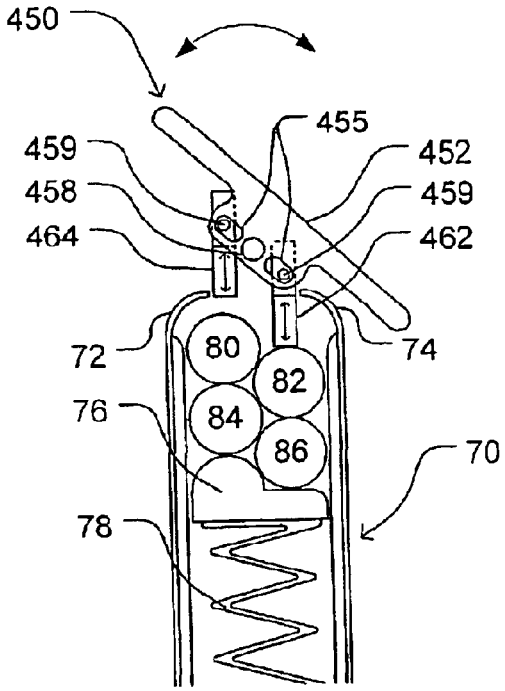
FIG. 8A is a simplified front view of an alternative side-to-side ART with alternative plungers.

FIG. 8A illustrates in simplified form yet another alternative embodiment of a ART. A side-to-side ART 450 is shown comprising an operating handle 452 which is tiltable about a pivot bar 458. Pivot bar 458 is located centrally above and longitudinally parallel to the rounds. The handle includes two elongated openings 455 positioned opposite each other about pivot 458. A slideable pivot pin 459 is disposed in each elongated opening 455. The pins are coupled to respective plungers 462 and 464. Each plunger has a substantially flat round-thrusting bottom surface and is bound by a guide 466 (FIG. 8C) to guide its movement to just an up-down direction traveling maximally 7 mm. The ART is shown tilted one way to create an extreme maximal thrust on round 82 by plunger 462. Plunger 464 is then upwardly cleared so that it is approximately at the level of lips 72 and 74.

Figure 8B:
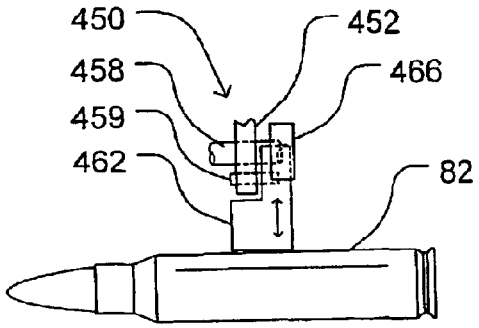
FIG. 8B is a simplified side view of the alternative plunger.

FIG. 8B is a simplified side view of a portion of ART 450. A side portion of tilted handle 452 is shown, as well as a side portion of pivot 458 and pivot pin 459. Further shown is a side view of plunger 462 as it thrusts round 82 directly below it, as illustrated also in FIG. 8A.

Figure 8C:
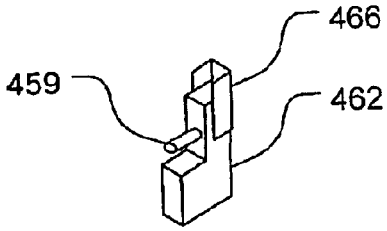
FIG. 8C is a simplified perspective view of the alternative plunger.

FIG. 8C is a simplified perspective view of plunger 462 showing extending pivot pin 459. A portion of guide 466 is shown as a part of the main body (not shown) of this modified Loader.

Again, the body of this modified loader with ART 450 is slightly modified-especially upper portion 16 where elongated side opening 28 (FIG. 1A) is now open to the top. Pivot 458 is positioned between a front and rear walls (similar to stops 24 and 26) of upper portion 16. Also, the shape of handle 52 with crown 54 of ART 50 may replace handle 452 of ART 450.

Operation

FIGS. 8A–C

As ART 450 (FIG. 8A) is tilted or pivoted side-to-side, plungers 462 and 464 alternately travel up and down for alternately thrusting a round directly below each plunger, similar to the action of ART 50 previously described.

Conclusion, Ramifications, and Scope

The reader will see that we have provided an efficient, pocket-size accessory and method for both loading and unloading rounds of a magazine. It provides more comfort and safety for the user, and an opportunity for the military and law-enforcement agencies to save on replacement of lips-damaged magazines.

While the above description contains many specificities, these should not be construed as limitation on the scope of the invention, but rather as an exemplification of one preferred embodiment thereof adapted for a specific type of magazine family.

All numerical values provided are approximate, and are variable to adapt to other magazines or round types and/or sizes. The following are further examples of some but not all variations and ramifications:

A Loader disclosed may be constructed to fit and operate with any double-stacked firearm magazines provided a suitable change in dimensions and lock mechanism arrangement is made.

The ART and main body of the Loader, as well as components thereof, may be made of separate or different plastic materials, or, alternatively, of other materials, such as aluminum, steel, etc. or any combination thereof.

The position of the plungers may switch such that each will appear on the opposite side to the width of the ART.

The ART's handle and/or crown, being a user-interface, may have other embodiments and/or being constructed elsewhere in the Loader, such as sideways.

An ART may comprise one wheeled plunger (as in ART 350) and one fixed plunger (as in ART 50). Further, ART 250 may include wheeled plungers, and also, any other number of plungers.

The main body can be made more elongated (extended down) to encompass a larger part of the magazine for reducing jiggling on a magazine where variations of the magazines' outer dimensions are encountered. This can occur when different manufacturers produce the same magazine type but with varying materials and dimensions. Alternatively, one or more downward extensions from the main body at selected location can be added.

Another lock mechanism may be substituted for the one provided. Further, other materials or metal/plastic inserts or a metal cover or similar additives for/over tooth 20 may be added or substituted to protect it against possible scraping by metal magazines lock hole or depression 71. The same applies to strengthen the plungers for prolonging their life.

The main body and ART may be made to fold, collapse, or taken apart such that they may be more compactly packed. They can be assembled prior to use.

One or more small fixed protrusions may replace the flexible bulges 56.

A bridge-like limiter between the two guard protrusions 22 of the main body 12 and above tongue 18 may be incorporated for limiting the movement of the tongue when it is pulled away to release the Loader from the magazine. Such a limiter will keep the tongue from breaking under excessive pulling force. Alternatively, other forms of limiters may be incorporated.

Other mechanisms for thrusting the rounds of the magazine conforming to the method described above may be constructed. Just one example is shown in FIGS. 8A-C.

A detachable container may be added to the Loader for holding loose rounds which are to be automatically fed to the Loader or magazine as the ART is operated. Also, the same or a second container may be included for receiving loose rounds as they free-fall out of the Loader during unloading.

An industrial machine using the apparatus and methods described may be designed for mass loading and/or unloading rounds into magazines. This machine may be used in military armories, shooting ranges, and in production plants. ART 250 (FIGS. 7B to C) may be used in such a machine.

An electromechanical device, as an electric motor, solenoid, and a power source (batteries or AC line), and a controller or switch, may be included in a modified Loader, or with the above described machine. This would electromechanically tilt or turn any of the ARTs previously described, especially ART 250 or a functionally equivalent one, for a volume operation.

According, the scope of the invention should be determined, not by the embodiments illustrated, but by the appended claims and their legal equivalents.

What is claimed is:

1. An accessory for facilitating the loading and unloading of rounds into a firearm magazine comprising a hollow body with an open side and which holds first and second columns of rounds and feeds such rounds out of said open side successively from alternate columns, comprising:

a hollow body shaped and sized to fit over and be attached to said open side of said magazine, an alternate round thruster mounted in said hollow body so that said alternate round thruster can be pivoted between first and second positions, said alternate round thruster having first and second plungers which extend into said magazine above said first and second columns of rounds, respectively, when said hollow body is attached to said open side of said magazine, said alternate round thruster having an operating handle extending out of said hollow body so that said alternate round thruster can be pivoted between said first and second positions by operating said operating handle, said first and second plungers being positioned so that (a) when said alternate round thruster is in said first position, said first plunger will extend down into said magazine lower than said second plunger, (b) when said alternate round thruster is pivoted from said first to said second position, said first plunger will move upwardly and said second plunger will move downwardly into said magazine to a position lower than said first plunger, and (c) when said alternate round thruster is pivoted from said second to said first position, said second plunger will move upwardly and said first plunger will move downwardly into said magazine to a position lower than said second plunger, whereby when said alternate round thruster is operated between said first and second positions, its plungers will either (a) push a topmost round in said magazine down to form a vacant space to facilitate loading of a new topmost round into said vacant space in said magazine, or (b) push a second-to-topmost round in said magazine down to release a spring force and facilitate unloading of a topmost round of said magazine.

2. The accessory of claim 1 wherein said first and second plungers are parallel members which are positioned to define an angle therebetween.

3. The accessory of claim 1 wherein said first and second plungers are parallel members, at least one of which has a rotatable member.

4. The accessory of claim 1 wherein said rounds are elongated and parallel and said alternate round thruster is mounted on a pivot bar that is perpendicular to said rounds.

5. The accessory of claim 1 wherein said rounds are elongated and parallel and said alternate round thruster is mounted on a pivot bar that is parallel to said rounds.

6. The accessory of claim 1 wherein said alternate round thruster is retactable inside said hollow body.

7. The accessory of claim 6 wherein said alternate round thruster comprises means for limiting the retractability thereof inside said hollow body.

8. The accessory of claim 1 wherein said hollow body comprises means for locking itself to said magazine.

9. The accessory of claim 1 wherein said hollow body and said alternate round thruster are made of plastic.

10. A method of loading and unloading a firearm magazine having an open side, comprising:

providing alternate round thrusting means comprising at least two thrusting plungers, providing mounting means for operatively positioning said alternate round thrusting means at said open side of said magazine, so that said thrusting plungers of said alternate round thrusting means are insertable through said open side or said magazine, positioning said alternate round thrusting means for exerting thrust against a topmost round in said magazine, alternately positioning said alternate round thrusting means for exerting thrust against a second-to-topmost round of said magazine, whereby rounds may be easily loaded or unloaded into said magazine, respectively.

11. The method of claim 10 wherein said thrusting plungers are parallel members which are positioned to define an angle therebetween.

12. The method of claim 10 wherein said thrusting plungers are parallel members wherein at least one of said members has a rotatable member.

13. The method of claim 10 wherein said rounds are elongated and parallel and said alternate round thrusting means is mounted on a pivot bar that is perpendicular to said rounds.

14. The method of claim 10 wherein said rounds are elongated and parallel and said alternate round thrusting means is mounted on a pivot bar that is parallel to said rounds.

15. The method of claim 10 wherein said alternate round thrusting means is retractable inside said mounting means.

16. The method of claim 15 wherein said alternate round thrusting means comprises means for limiting the retractability thereof inside said mounting means.

17. The method of claim 10 wherein mid mounting means comprises means for locking itself to said magazine.

18. The method of claim 10 wherein said mounting means and said alternate round thrusting means are made of plastic.

19. A accessory for facilitating the loading and unloading of rounds, comprising:

a hollow body having an open end and a predetermined shape and size, an alternate round thruster mounted in said hollow body so that said alternate round thruster can be pivoted between first and second positions, said alternate round thruster having first and second plungers, said alternate round thruster having an operating handle extending out of said hollow body so that said alternate round thruster can be pivoted between said first and second positions by operating said operating handle, said first and second plungers being positioned so that (a) when said alternate round thruster is in said first position, said first plunger will extend down lower than said second plunger, (b) when said alternate round thruster is pivoted from said first to said second position, said first plunger will move upwardly and said second plunger will move downwardly to a position lower than said first plunger, and (c) when said alternate round thruster is pivoted from said second to said first position, said second plunger will move upwardly and said first plunger will move downwardly to a position lower than said second plunger, whereby when said alternate round thruster is operated between said first and second positions, its plungers will alternatively extend to a lowermost position, whereby when said accessory is attached to a firearm magazine said accessory can facilitate loading and unloading of rounds.

20. The accessory of claim 19, further including means for locking said hollow body to said firearm magazine.

21. The accessory of claim 19 wherein said first and second plungers are parallel members which are positioned to define an angle therebetween and said hollow body has parallel sides surfaces and said alternate round thruster is mounted on a pivot bar that is perpendicular to said parallel sides surfaces.

22. A firearm magazine loader and unloader accessory for magazines having an open side and containing topmost and second-to-topmost rounds which are exposed at and urged towards said open side, comprising:

thrusting means for alternately (a) thrusting said topmost round farther into said magazine for creating space adjacent said open side for enabling a new round to be loaded into said space, and (b) thrusting said second-to-topmost round farther into said magazine for releasing force on said topmost round to enable said topmost round to fall out of said magazine, and mounting means for operatively positioning said thrusting means at said open side of said magazine, whereby by sequentially thrusting topmost rounds farther into said magazine, said magazine may be easily loaded with new rounds, and alternatively, when sequentially thrusting second-to-topmost rounds farther into said magazine, topmost rounds may be easily unloaded.

23. The accessory of claim 22 wherein said thrusting means is an alternate round thruster comprising at least two thrusting plungers and said mounting means is a body shaped and sized to fit over and be attached to said open side of said magazine.

* * * * *